US010301865B2

(12) United States Patent
Son et al.

(10) Patent No.: US 10,301,865 B2
(45) **Date of Patent: *May 28, 2019**

(54) DOOR OPENING AND CLOSING DEVICE FOR REFRIGERATOR

(71) Applicant: LG ELECTRONICS INC., Seoul (KR)

(72) Inventors: Changwoo Son, Seoul (KR); Myoungju Kang, Seoul (KR); Cholok Han, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/508,680

(22) PCT Filed: Sep. 4, 2015

(86) PCT No.: PCT/KR2015/009385
§ 371 (c)(1),
(2) Date: Mar. 3, 2017

(87) PCT Pub. No.: WO2016/036212
PCT Pub. Date: Mar. 10, 2016

(65) Prior Publication Data

US 2017/0260794 A1 Sep. 14, 2017

(30) Foreign Application Priority Data

Sep. 5, 2014 (KR) ..... 10-2014-0119165

(51) Int. Cl.
*F25D 23/02* (2006.01)
*E05F 15/614* (2015.01)
(Continued)

(52) U.S. Cl.
CPC ..... *E05F 15/614* (2015.01); *E05F 15/75* (2015.01); *E06B 5/00* (2013.01); *E06B 7/215* (2013.01);
(Continued)

(58) Field of Classification Search
CPC .. F25D 23/028; F25D 29/003; F25D 2900/31; E05F 15/614; E05F 15/75
See application file for complete search history.

(56) References Cited

U.S. PATENT DOCUMENTS 1,831,800 A * 11/1931 Bales ..... E05D 11/1014 126/191
2,659,115 A * 11/1953 Anderson ..... E05O 19/161 292/251.5
(Continued)

FOREIGN PATENT DOCUMENTS

CN 201876047 6/2011
JP 2001-055863 2/2001
(Continued)

OTHER PUBLICATIONS

Espacenet Machine Translation, JP2001055863, pp. 1-18 printed from http://translationportal.epo.org on Jan. 22, 2018.*
(Continued)

*Primary Examiner* — Kimberley S Wright
(74) *Attorney, Agent, or Firm* — Fish & Richardson P.C.

(57) ABSTRACT

A door opening and closing device for a refrigerator includes a door coupled by means of a hinge unit to a main body defining a storage compartment therein, a gasket disposed between the door and the main body to provide a hermetic seal therebetween, and an opening and closing unit for opening and closing the door with respect to the main body, wherein the opening and closing unit includes a drive unit for generating a driving force, a gasket separation mecha-
(Continued)

nism for pushing the main body using rotational force transmitted from the drive unit to separate the gasket from the main body or the door, and a door rotating mechanism for rotating the door using the rotational force transmitted from the drive unit.

17 Claims, 11 Drawing Sheets

(51) Int. Cl.
*E05F 15/75* (2015.01)
*E06B 5/00* (2006.01)
*E06B 7/215* (2006.01)
*F25D 29/00* (2006.01)

(52) U.S. Cl.
CPC ..... *F25D 23/028* (2013.01); *F25D 29/003* (2013.01); *E05Y 2201/434* (2013.01); *E05Y 2201/716* (2013.01); *E05Y 2201/722* (2013.01); *E05Y 2400/36* (2013.01); *E05Y 2400/40* (2013.01); *E05Y 2400/85* (2013.01); *E05Y 2900/31* (2013.01)

(56) References Cited

U.S. PATENT DOCUMENTS 2,975,013 A * 3/1961 Wallace ..... E05D 3/022 16/235
3,394,428 A * 7/1968 Peterson ..... E05D 3/022 16/354
3,864,875 A * 2/1975 Hewitt ..... E05F 15/50 49/115
4,727,679 A * 3/1988 Kornbrekke ..... E05F 15/63 49/138
5,040,857 A * 8/1991 Mandel ..... E05D 3/022 16/364
5,579,606 A * 12/1996 Kim ..... E05F 1/1246 16/284
5,988,709 A * 11/1999 Lee ..... E05B 65/0042 292/199
6,108,975 A * 8/2000 Bailey ..... E05F 1/105 49/334
6,338,536 B1 * 1/2002 Ueno ..... E05L 317/0033 312/405
6,845,545 B2 * 1/2005 Han ..... E05F 1/1269 16/277
7,192,105 B2 * 3/2007 Jung ..... E05D 11/1064 312/405
7,213,369 B2 * 5/2007 Freeman ..... G10L 15/26 49/358
7,407,200 B2 * 8/2008 Ichimaru ..... E05C 17/02 292/194
7,473,223 B2 * 1/2009 Fetzer ..... A61B 90/50 292/199
7,765,645 B2 * 8/2010 Kim ..... A47B 95/02 16/412
7,887,147 B2 * 2/2011 Karg ..... E05F 1/1066 312/319.2
7,984,955 B2 * 7/2011 Jung ..... F25D 23/028 312/405
8,104,800 B2 * 1/2012 Lorek ..... E05B 63/18 292/108
8,132,876 B2 * 3/2012 An ..... F25D 23/028 312/405
8,297,725 B2 * 10/2012 Kim ..... F25D 23/028 312/319.7
8,347,553 B2 * 1/2013 Hecht ..... E05D 3/16 312/319.5
8,444,237 B2 * 5/2013 Kang ..... F25D 23/028 312/319.2
8,454,102 B2 * 6/2013 Kim ..... E05F 15/619 312/319.5
8,469,469 B2 * 6/2013 Kim ..... E05B 17/0029 312/319.5
8,505,996 B1 * 8/2013 Shin ..... B60R 7/06 296/37.12
8,981,698 B2 * 3/2015 Fuhge ..... E05F 15/611 318/484
9,062,911 B2 * 6/2015 Keller ..... F25D 17/047
9,097,052 B2 * 8/2015 Chen ..... F25D 23/02
9,163,870 B2 * 10/2015 Jeon ..... F25D 23/028
9,534,829 B2 * 1/2017 Held ..... F25D 23/028
9,695,624 B2 * 7/2017 Heydel ..... H02K 7/116
9,909,800 B2 * 3/2018 Jung ..... F25D 23/02
9,933,202 B2 * 4/2018 Kang ..... F25D 23/025
2004/0040118 A1 * 3/2004 Han ..... E05F 1/1269 16/277
2005/0212392 A1 * 9/2005 Jung ..... E05D 11/1064 312/405
2005/0262868 A1 * 12/2005 Jeong ..... E05F 1/1091 62/408
2006/0053916 A1 * 3/2006 Tanaka ..... E05F 15/619 74/422
2006/0107597 A1 5/2006 Jin et al.
2006/0232176 A1 * 10/2006 Kim ..... E05D 3/12 312/405
2007/0186480 A1 * 8/2007 Freeman ..... G10L 15/26 49/358
2008/0000052 A1 * 1/2008 Hong ..... E05B 17/0033 16/382
2008/0066481 A1 * 3/2008 An ..... F25D 23/028 62/265
2008/0083243 A1 * 4/2008 Lee ..... F25D 23/028 62/446
2008/0163462 A1 * 7/2008 King ..... E05B 17/0033 16/412
2008/0284301 A1 * 11/2008 Kim ..... A47B 95/02 312/405
2009/0033189 A1 * 2/2009 Glanz ..... E05F 1/105 312/405
2009/0179540 A1 * 7/2009 Seo ..... E05B 17/0033 312/405
2010/0018122 A1 * 1/2010 Hecht ..... E05D 3/16 49/31
2010/0018240 A1 1/2010 Hecht et al.
2010/0141107 A1 * 6/2010 Kim ..... F25D 23/028 312/405
2010/0283360 A1 * 11/2010 Binder ..... E05L 317/0029 312/209
2011/0048060 A1 * 3/2011 Kim ..... E05B 17/0029 62/449
2011/0273070 A1 * 11/2011 Shin ..... F25D 23/028 312/405
2013/0099715 A1 * 4/2013 Fuhge ..... E05F 15/611 318/484
2016/0312516 A1 * 10/2016 Heydel ..... H02K 7/116
2016/0313050 A1 * 10/2016 Yoon ..... E06B 7/18
2017/0097185 A1 * 4/2017 Yasaka ..... E05F 15/614
2017/0261252 A1 * 9/2017 Son ..... F25D 23/028
2017/0336132 A1 * 11/2017 Chang ..... F25D 23/028
2018/0223582 A1 * 8/2018 Shin ..... F25D 23/028

FOREIGN PATENT DOCUMENTS

JP 2010-025461 2/2010
JP 2015055130 A 3/2015
KR 10-1996-0014861 5/1996
KR 10-2006-0094819 8/2006
KR 10-2009-0075278 7/2009

OTHER PUBLICATIONS

Espacenet Machine Translation, JP2010025461, pp. 1-28 printed from http://translationportal.epo.org on Jan. 22, 2018.*
International Search Report in International Application No. PCT/KR2015/009385, dated Dec. 24, 2015, 2 pages.
European Extended Search Report in European Application No. 15838690.4, dated Apr. 24, 2018, 8 pages.

(56) References Cited

OTHER PUBLICATIONS

Chinese Office Action in Chinese Appln. No. 201580060432.4, dated Dec. 29, 2018, 12 pages (with English translation).

* cited by examiner

【Figure 1】
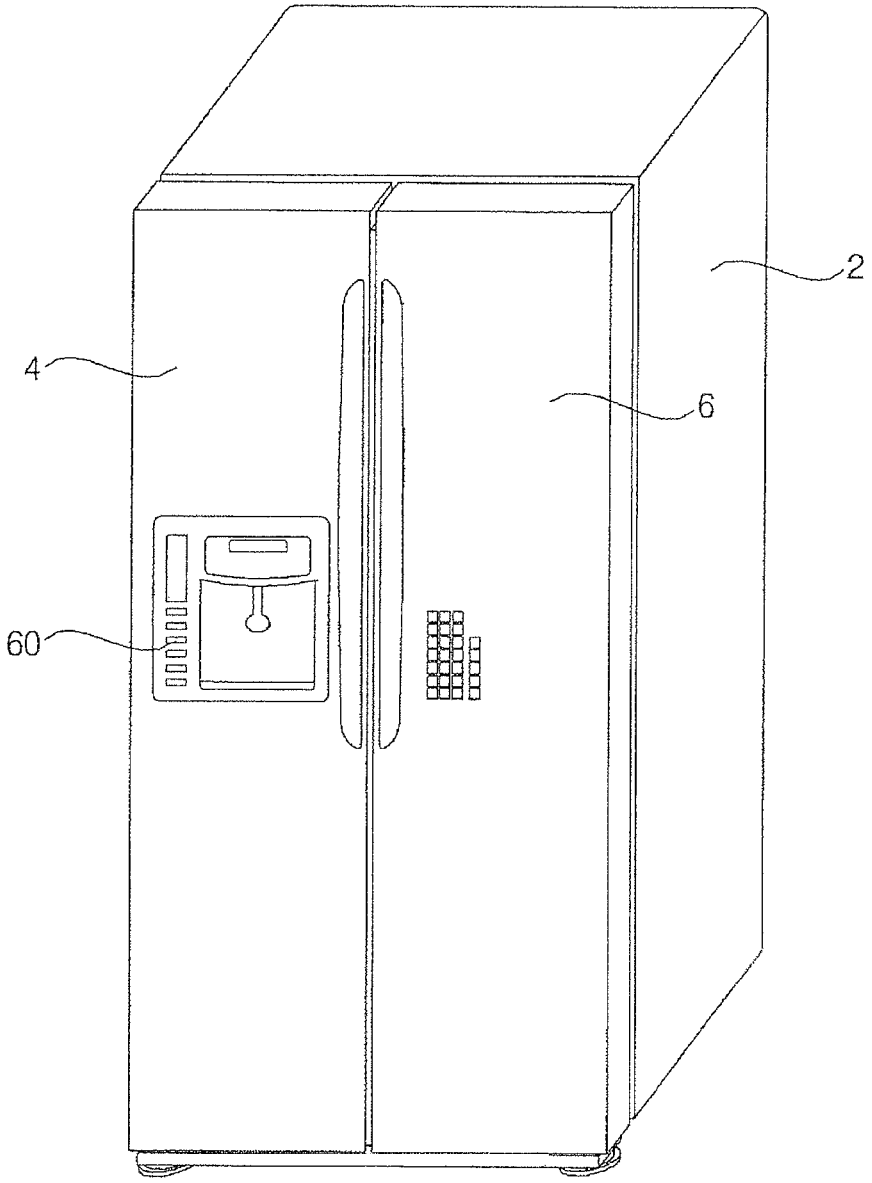

【Figure 2】
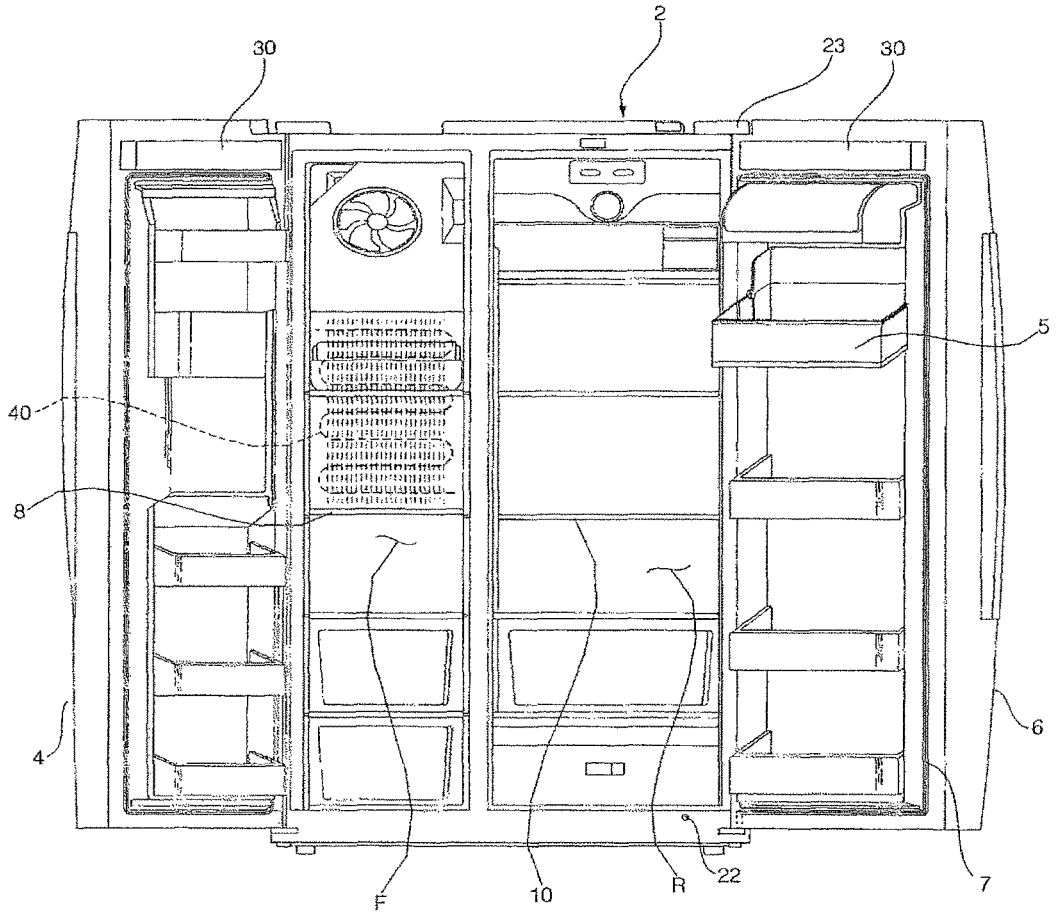

【Figure 3】
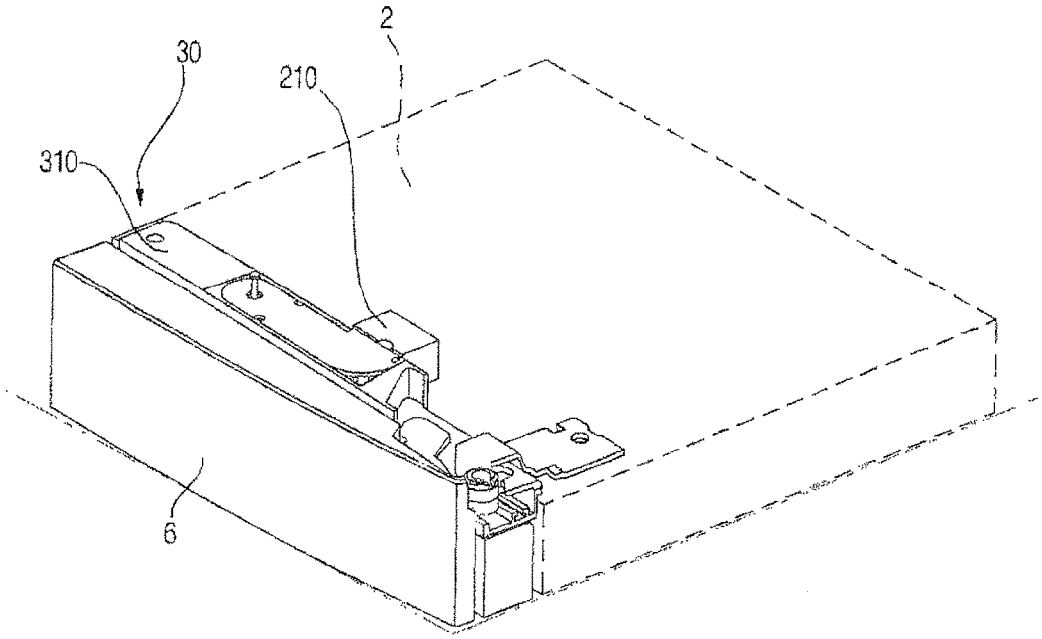

【Figure 4】
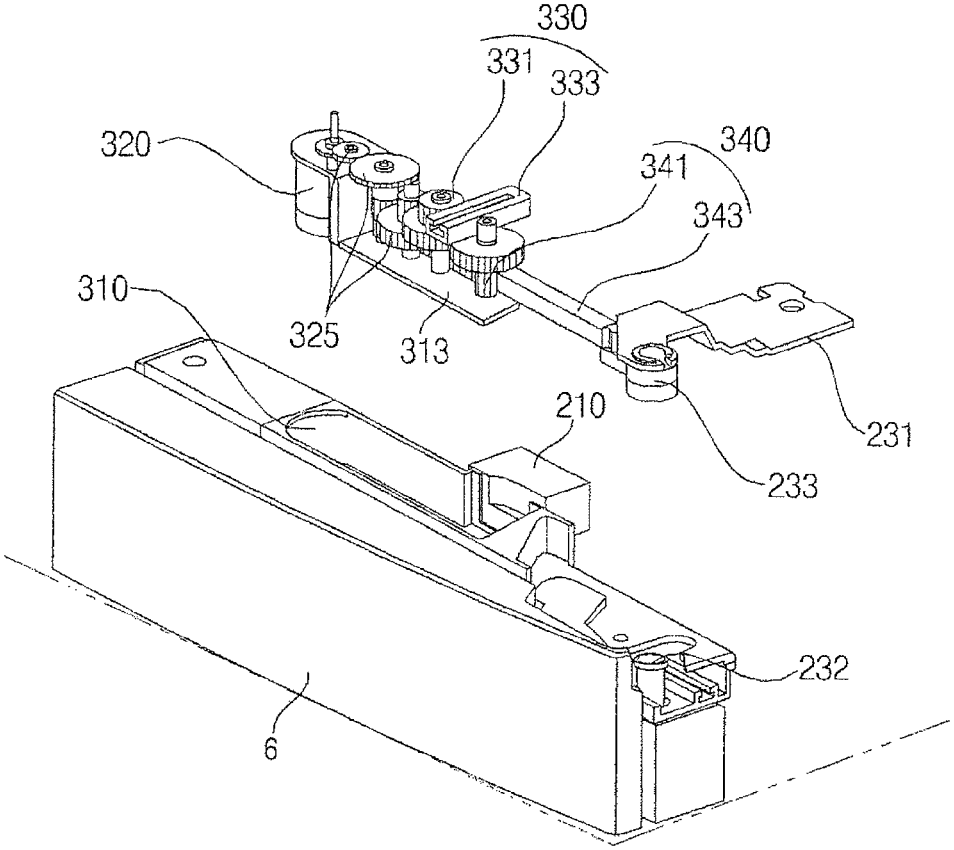

【Figure 5】
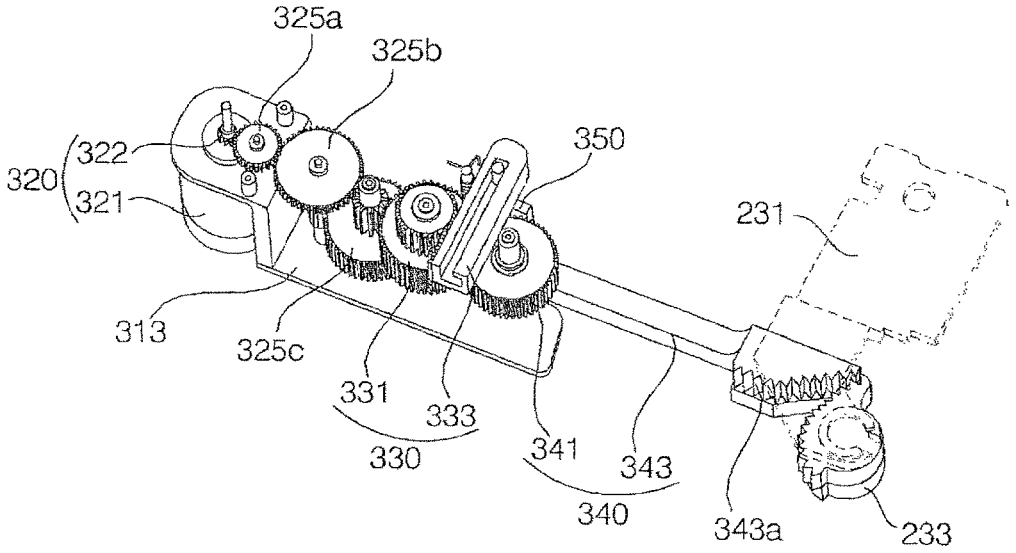

【Figure 6】
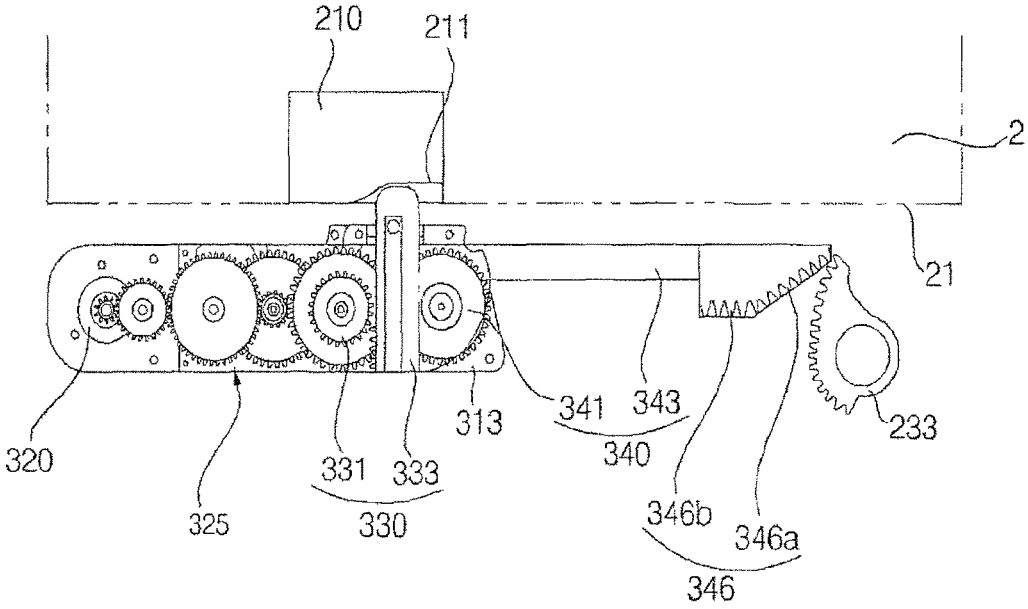
【Figure 7】
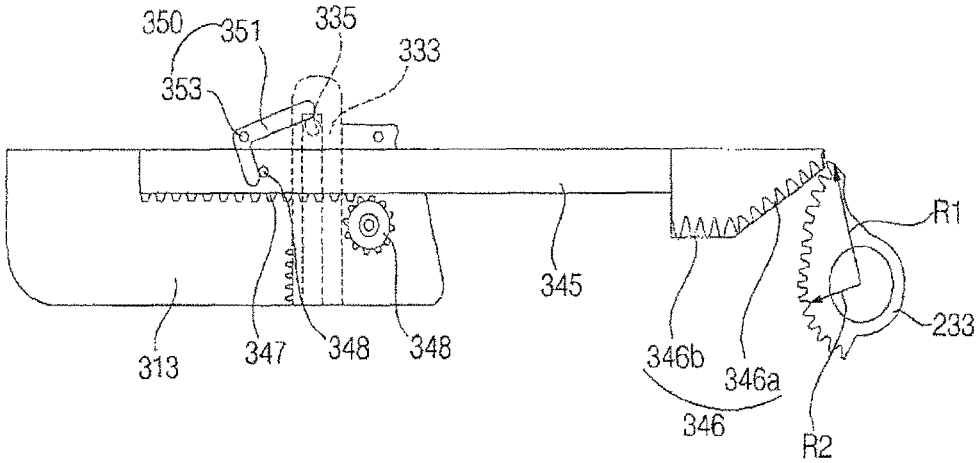

【Figure 8】
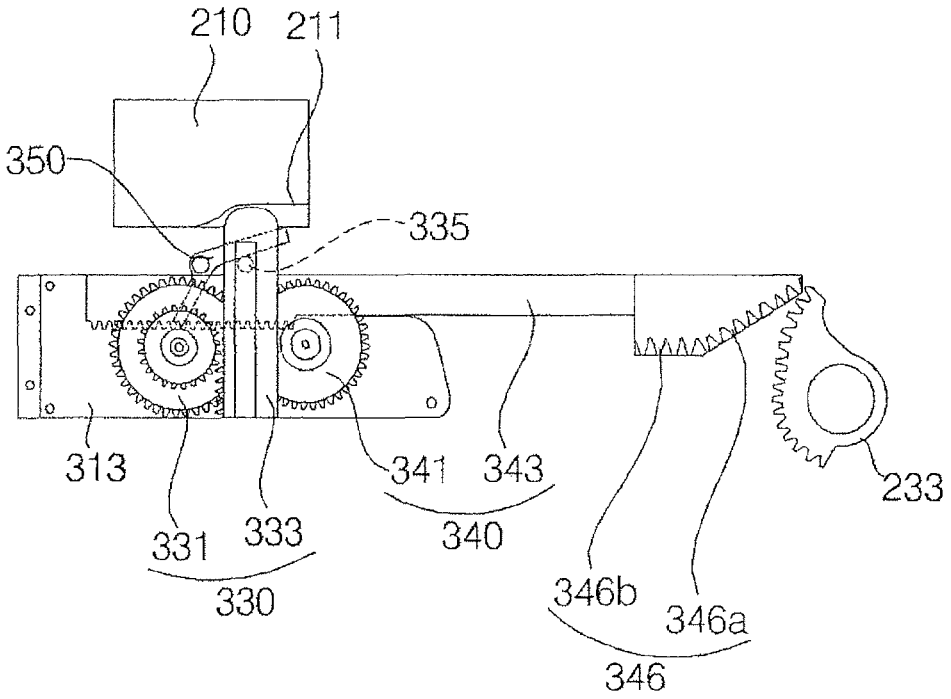

【Figure 9】
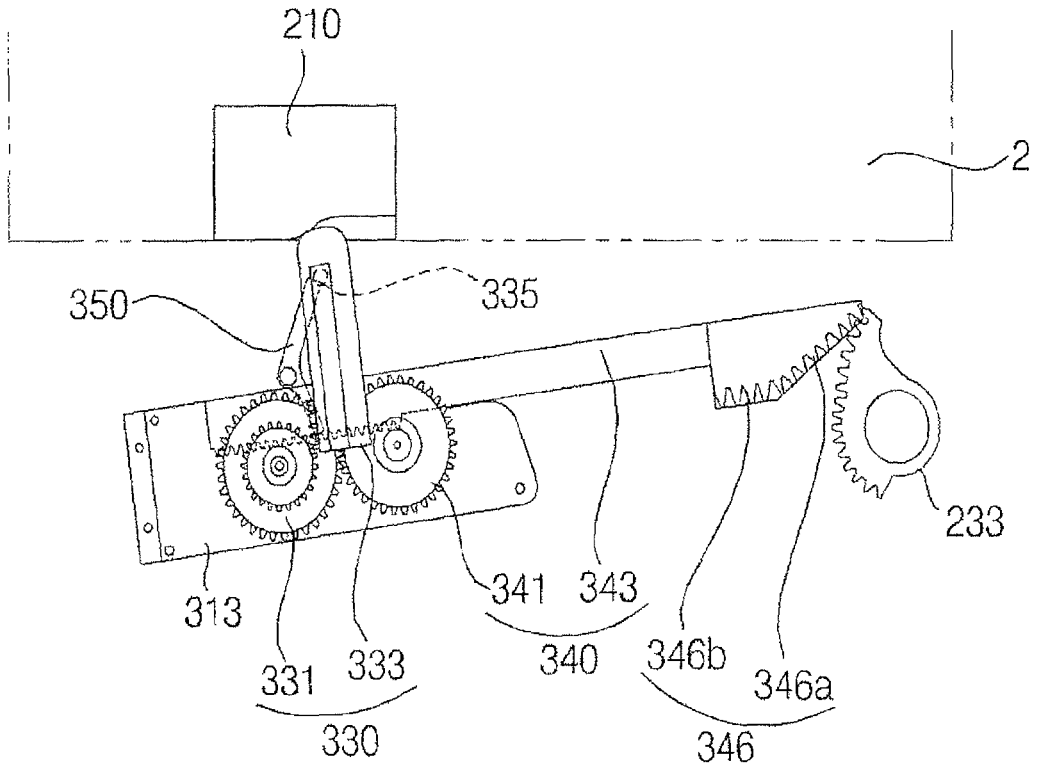

【Figure 10】
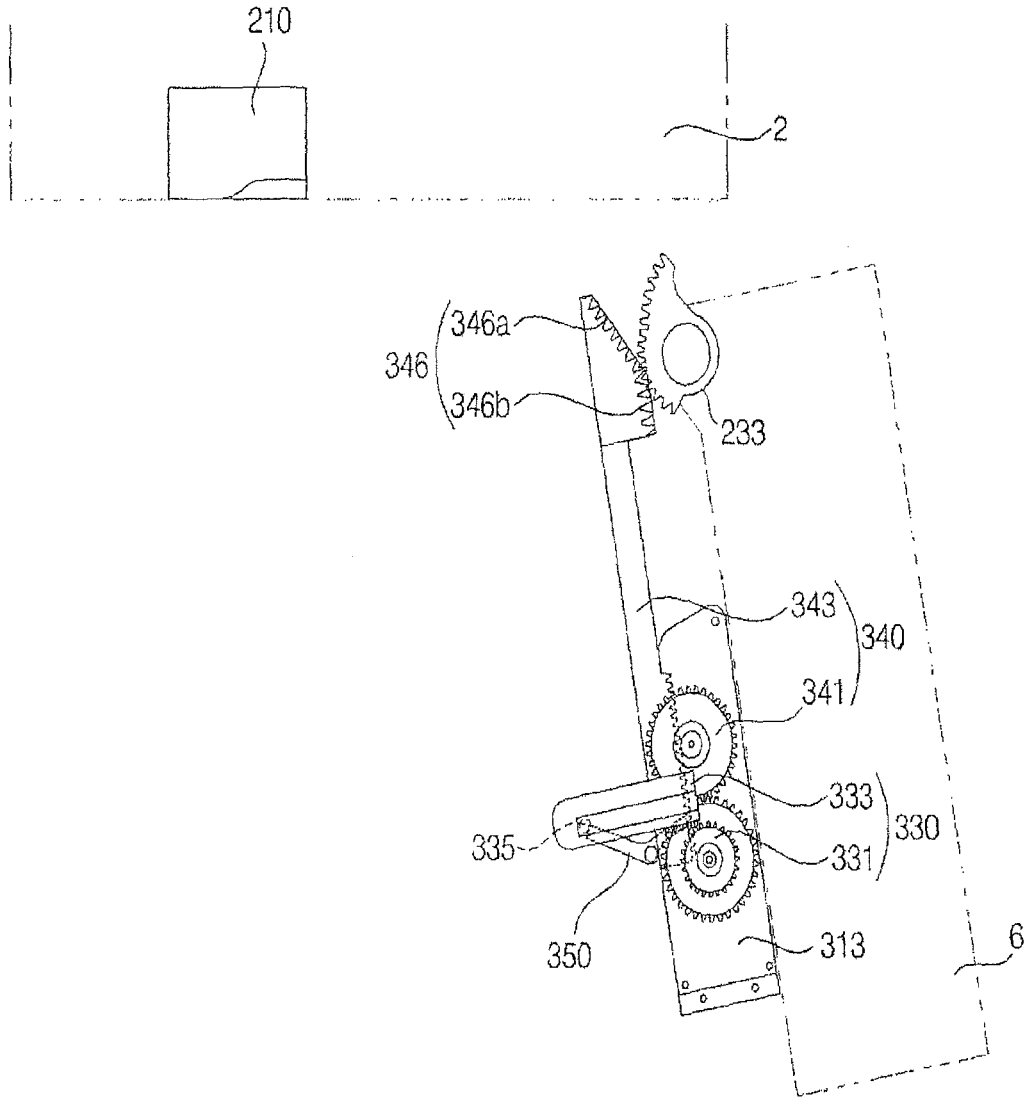

【Figure 11】
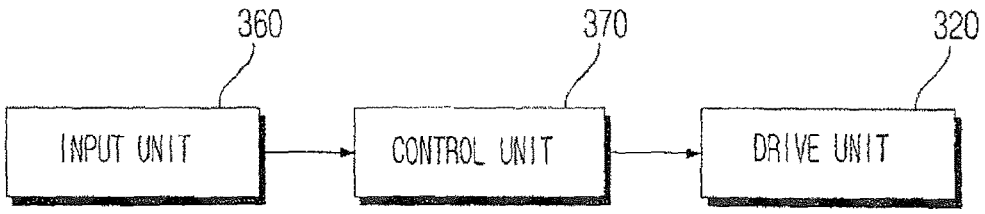

【Figure 12】
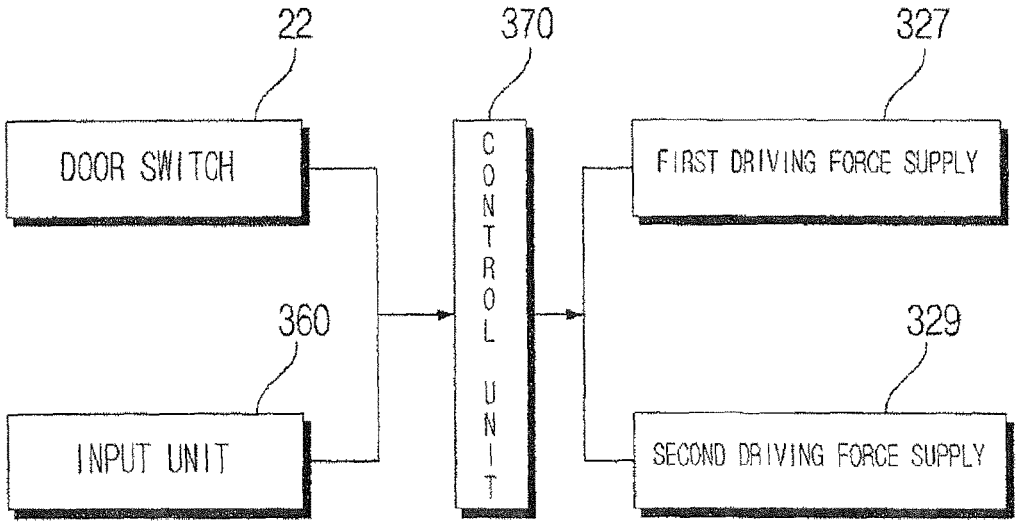

DOOR OPENING AND CLOSING DEVICE FOR REFRIGERATOR

CROSS REFERENCE TO RELATED APPLICATIONS

This application is a U.S. National Phase Application under 35 U.S.C. § 371 of International Application PCT/KR2015/009385, filed on Sep. 4, 2015, which claims the benefit of Korean Application No. 10-2014-0119165, filed on Sep. 5, 2014, the entire contents of which are hereby incorporated by reference in their entireties.

TECHNICAL FIELD

The present invention relates to a door opening and closing device for a refrigerator.

BACKGROUND ART

In general, a refrigerator is an apparatus for storing objects to be kept in a fresh state for a long period of time using cool air supplied into a storage compartment. The cool air supplied into the storage compartment is created through heat exchange with a refrigerant. The cool air supplied into the storage compartment is uniformly distributed throughout the storage compartment by convection so that foodstuffs can be stored at a desired temperature.

The storage compartment is defined in a main body that forms the appearance of the refrigerator. The storage compartment is open at the front thereof such that foodstuffs can be received through the opening. A door to open and close the storage compartment is mounted at the front of the storage compartment. The door is hinged to the main body to open and close the storage compartment.

In order to prevent the leakage of cold air to the outside and to ensure close contact between the main body and the door, a gasket is disposed between the main body and the door.

The gasket is typically magnetic in order to improve sealing performance.

In order to open the door automatically, it is necessary to provide force not only to rotate the door but additionally to separate the gasket from the main body.

In conventional refrigerators, a technology of connecting a motor to a hinge unit of a door is used. In this case, since there is a significant difference between the force required to separate the gasket and the force required to rotate the door, an excessively large actuator is necessary, which is inefficient. In addition, since the refrigerator is required to have increased space in order to accommodate the large actuator, it is difficult to provide the increased space without compromising the size or thermal insulation performance of a conventional refrigerator.

DISCLOSURE

Technical Problem

Therefore, the present invention has been made in view of the above problems, and it is an object of the present invention to provide a door opening and closing device for a refrigerator, which is capable of opening and closing a door of a refrigerator using a low-powered compact motor.

Technical Solution

In accordance with an aspect of the present invention, the above and other objects can be accomplished by the provision of a door opening and closing device for a refrigerator including a door, coupled by means of a hinge unit to a main body defining a storage compartment therein, a gasket disposed between the door and the main body to provide hermetic seal therebetween, and an opening and closing unit for opening and closing the door with respect to the main body, wherein the opening and closing unit includes a drive unit for generating a driving force, a gasket separation mechanism for pushing the main body using the rotational force transmitted from the drive unit to separate the gasket from the main body or the door, and a door rotating mechanism for rotating the door using the rotational force transmitted from the drive unit.

The gasket separation mechanism may include a push pinion gear for transmitting the rotational force of the drive unit, and a push rack engaging with the push pinion gear to increase the distance between the main body and the door.

*11 The push rack may move linearly toward the front of the main body from the rear side of the door.

The push rack may be spaced apart from an axis of the hinge unit by a distance ranging from 30% to 60% of the width of the door.

The door opening and closing device may further include a rack guide provided on the front surface of the main body to guide the push rack, wherein the rack guide progressively protrudes in the direction of the door as it moves away from the hinge unit.

The door rotating mechanism may be operated after the gasket is separated from the main body or the door by means of the gasket separation mechanism.

The door opening and closing device may further include a door switch for detecting that the door is opened with respect to the main body to a predetermined angle, wherein the drive unit includes a first driving force supply for supplying rotational force to the gasket separation mechanism, and a second driving force supply, for supplying rotational force to the door rotating mechanism, wherein the door opening and closing device further includes a control unit for operating the first and second driving force supplies in response to a signal input through the door switch such that there is a time interval between the operation of the first driving force supply and the operation of the second driving force supply.

The door rotating mechanism may include a rotational pinion gear, for transmitting the rotational force of the drive unit, and a rotational rack that engages with the rotational pinion gear and moves linearly, wherein the rotational rack engages with a hinge gear formed on the outer surface of the hinge unit.

The door opening and closing device may further include a synchronizer, which is rotated by the push rack so as to cause the rotational rack to engage with the rotational pinion gear.

The rotational rack may move linearly in the width direction of the door, and the synchronizer may be rotated by the push rack so as to move the rotational rack toward the hinge unit.

The rotational rack may include a body, an engaging gear formed at one end of the body to engage with the rotational pinion gear, and an acceleration gear formed at the other end of the body to engage with the hinge gear so as to change the rotational speed of the door.

The acceleration gear may include a first gear section inclined with respect to the moving direction of the rotational rack, and a second gear section parallel to the moving direction of the rotational rack.

The hinge gear may have a radius that decreases in the direction in which the door opens.

In the initial stage of the action of opening the door, the acceleration gear of the rotational rack may engage with the portion of the hinge gear that has a largest radius.

The opening and closing unit may be coupled to the door so as to be positioned in a space defined between the door and the main body.

The opening and closing unit may be positioned outside an area defined by the gasket.

The door opening and closing device may further include an input unit through which a door opening or closing command is input, and a control unit for controlling the opening and closing unit in response to the door opening or closing command input through the input unit.

The input unit may invert an opening or closing command, input by user's voice or touch into, an electronic signal.

The storage compartment may be cooled by a cooling device that exchanges heat with the outside of the storage compartment.

The gasket separation mechanism may be disposed so as to be spaced apart from a hinge shaft of the hinge unit by a predetermined distance.

Advantageous Effects

The door opening and closing device for a refrigerator according to the present invention provides at least one of the following effects.

Since the door opening and closing device according to an embodiment incorporates therein a gasket separation mechanism for separating a gasket and a door rotating mechanism for rotating a door after separation of the gasket, it is possible to separate the gasket from the main body using a small force and to open and close the door at a high speed.

Furthermore, since the gasket separation mechanism and the door rotating mechanism are operated by a single driving force source, the space defined between the door and the main body is reduced.

In addition, since the force applied to the door and the rotational speed of the door vary in accordance with the operating range of the door thanks to the adoption of a rack guide and a hinge gear and a rotational rack having a varying radius, it is possible to realize a door which is operated smoothly and naturally and which exhibits a high efficiency.

Furthermore, it is possible to incorporate even a low-powered compact motor into a drive unit of the door opening and closing device.

DESCRIPTION OF DRAWINGS

The above and other objects, features and other advantages of the present invention will be more clearly understood from the following detailed description taken in conjunction with the accompanying drawings, in which:

FIG. 1 is a perspective view showing a refrigerator according to a first embodiment of the present invention;

FIG. 2 is a front view showing the refrigerator shown in FIG. 1 in which the doors of the refrigerator are open;

FIG. 3 is a perspective view showing the door opening and closing device for a refrigerator according to a first embodiment of the present invention;

FIG. 4 is an exploded perspective view showing the door opening and closing device for a refrigerator according to the first embodiment of the present invention;

FIG. 5 is a perspective view showing an opening and closing unit according to the first embodiment of the present invention;

FIG. 6 is a plan view showing the opening and closing unit according to the first embodiment of the present invention;

FIG. 7 is a plan view partially showing the opening and closing unit according to the first embodiment of the present invention;

FIGS. 8 to 10 are plan views showing the operation of the door opening and closing device for a refrigerator according to the first embodiment of the present invention;

FIG. 11 is a control block diagram of a door opening and closing device for a refrigerator according to a second embodiment of the present invention; and FIG. 12 is a control block diagram of a door opening and closing device for a refrigerator according to a third embodiment of the present invention.

BEST MODE

The advantages, features and methods for achieving those in the embodiments may become apparent upon referring to the embodiments, described later in detail together with attached drawings. However, the embodiments are not limited to the embodiments disclosed hereinafter, but may be embodied in different modes. The embodiments are provided for completeness of disclosure and informing the scope to persons skilled in this field of art. The same reference numbers may refer to the same elements throughout the specification.

Unless otherwise defined, all terms (including technical and scientific terms) used in this specification have the same meaning as commonly understood by a person having ordinary skill in the art to which the present invention pertains. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

In the drawings, the thickness or size of each element is exaggerated, omitted, or schematically illustrated for convenience of description and clarity. In addition, the size or area of each element does not necessarily reflect the actual size thereof.

In addition, angles or directions used to describe the structures of embodiments of the present invention are based on those shown in the drawings. Unless there is, in the description of the structures of embodiments of the present invention disclosed in this specification, no definition of the reference points and the positional relationships in the respective drawings, the associated drawings may be referred to.

Hereinafter, refrigerators according to embodiments of the present invention will be described with reference to the accompanying drawings.

FIG. 1 is a perspective view showing a refrigerator according to a first embodiment of the present invention, and FIG. 2 is a front view showing the refrigerator shown in FIG. 1 in which the doors of the refrigerator are open.

As shown in FIGS. 1 and 2, the refrigerator according to the embodiment of the present invention includes a main body 2 having storage compartments F and R defined therein, a cooling device 40 for cooling the storage compartments F and R, and doors 4 and 6 for opening and closing the storage compartments F and R, respectively.

The cooling device 40 exchanges heat with the outside so as to cool the storage compartments F and R. The cooling device 40 may be constituted by a refrigeration cycle device including a compressor, a condenser, an expansion unit, and an evaporator. Alternatively, the cooling device 40 may be constituted by a thermoelectric element that includes first and second metals, which are different from each other and are spaced apart from each other such that one of the first and second metals absorbs heat and the other of the first and second metals radiates heat by applying current to the first and second metals. Hereinafter, the cooling device 40 will be described as being constituted by the refrigeration cycle device.

The cooling device 40 circulates a refrigerant in order of the compressor→the condenser→the expansion device→the evaporator→the compressor to cool the storage compartments F and R.

The evaporator of the cooling device 40 may be disposed in contact with the outer walls of the storage compartments F and R so as to directly cool the storage compartments F and R. Alternatively, the cooling device 40 may further include a cool air circulation fan to circulate air in the storage compartments F and R through the evaporator and the storage compartments F and R such that the air in the storage compartments F and R can cool the storage compartments F and R while circulating through the storage compartments F and R and the evaporator.

The storage compartments F and R of the main body 2 may be provided therein with shelves 8 and 10, on which objects to be stored, such as foodstuffs and side dishes, are placed.

In addition, the storage compartments F and R of the main body 2 may be provided therein with a vegetable container for storing vegetables and fruits.

The storage compartments F and R may be defined in the main body 2 by storage compartment frames 21. The storage compartment frames 21 provide areas with which the doors 4 and 6 come into contact, and define the walls of the storage compartments F and R.

The storage compartment frames 21 are formed to correspond to the peripheries of rear surfaces of the doors 4 and 6 so as to closely contact the rear surfaces.

Specifically, the storage compartment frames 21 have respective inner surfaces that are inwardly stepped and come into close contact with the doors 4 and 6.

The doors 4 and 6 are installed at the main body 2 so as to swing left and right or up and down. A door basket 5 for storing drinks such as spring water, milk, juice, and alcoholic beverages or frozen foods such as ice cream is disposed at the side of the doors 4 and 6 that faces the storage compartments F and R (i.e. the rear of the doors) when the doors 4 and 6 are closed.

The door basket 5 is preferably composed of a plurality of door baskets 5 which are mounted at the doors 4 and 6 so as to be vertically spaced apart from each other.

The storage compartments F and R may include a freezing compartment F and a refrigerating compartment R. The doors 4 and 6 may include a freezing compartment door 4 for opening and closing the freezing compartment F and a refrigerating compartment door 6 for opening and closing the refrigerating compartment R. The shelves 8 and 10 may include a freezing compartment shelf 8 disposed in the freezing compartment F and a refrigerating compartment shelf 10 disposed in the refrigerating compartment R. The door basket 5 may be mounted in the freezing compartment F to store objects to be frozen, such as ice cream, or in the refrigerating compartment R to store objects to be refrigerated, such as milk, juice, and alcoholic beverages.

The doors 4 and 6 are hinged to the main body 2 by means of hinge units 23 to open and close the storage compartments F and R, respectively.

The doors 4 and 6 may have any size and shape so long as they shield the storage compartments F and R. By way of example, the storage compartment frames 21 constituting the walls of the storage compartments F and R may be configured to have a rectangular shape such that the storage compartment frames 21 closely contact the peripheries of the doors 4 and 6.

The door basket 5 for supporting storage objects may be disposed at the center of the rear surface of each of the doors 4 and 6. A locking unit (not shown) may be further provided to couple each of the doors 4 and 6 to the main body 2.

Furthermore, door switches 22 may be provided to detect the opening of the doors 4 and 6 and the angles at which the doors 4 and 6 are open.

In addition, there may be gaskets 7 disposed between the doors 4 and 6 and the main body 2 to provide seals therebetween.

The gaskets 7 are positioned between the respective doors 4 and 6 and the main body 2 to seal the storage compartments F and R.

In order to prevent outside air from entering the storage compartments F and R, each of the gaskets 7 may constitute a closed loop surrounding at least one of the storage compartments F and R.

Specifically, the gaskets 7 may be disposed between the storage compartment frames 21 constituting the walls of the storage compartments F and R and the rear surfaces of the doors 4 and 6, which contact the storage compartment frames 21. Furthermore, the gaskets 7 may be attached to the storage compartment frames 21 or the rear surfaces of the doors 4 and 6.

More specifically, the gaskets 7 may be attached to the peripheries of the rear surfaces of the doors 4 and 6. Accordingly, the gaskets 7 may closely contact the rear surfaces of the doors 4 and 6 when the doors 4 and 6 are closed, and thus the storage compartments may be maintained in the sealed state by means of the gaskets 7.

Generally, since the gaskets 7 are magnetic, the adherence between the doors 4 and 6 and the main body 2 is improved.

In order to automatically open the door 4 or 6, it is necessary to provide force not only to rotate the door 4 or 6 but also to separate the gasket 7 from the main body 2. Hereinafter, the gaskets 7 will be described as being coupled to the rear surfaces of the doors 4 and 6.

In conventional refrigerators, a technology for coupling a motor to a hinge shaft of each of the doors 4 and 6 has been used. In this case, since there is a great difference between the force required to separate the gasket 7 and the force required to rotate each of the doors 4 and 6, it is required to provide an excessively large actuator and a large space for accommodating the large actuator. Accordingly, it is difficult to incorporate the actuator into existing refrigerators without compromising the volumes or thermal insulation efficiency of the existing refrigerators.

In order to solve the above problems, an opening and closing device for a refrigerator door according to embodiments of the present invention is devised.

Hereinafter, the door opening and closing device for a refrigerator will be described in detail.

FIG. 3 is a perspective view showing the door opening and closing device for a refrigerator according to a first embodiment of the present invention. FIG. 4 is an exploded perspective view showing the door opening and closing device for a refrigerator according to the first embodiment of the present invention. FIG. 5 is a perspective view showing an opening and closing unit according to the first embodiment of the present invention. FIG. 6 is a plan view showing the opening and closing unit according to the first embodiment of the present invention. FIG. 7 is a plan view partially showing the opening and closing unit according to the first embodiment of the present invention.

The door opening and closing device for a refrigerator according to the first embodiment of the present invention includes a door 4 or 6 coupled to the main body 2 via the hinge unit 23, the gasket 7 disposed between the door 4 or 6 and the main body 2 to provide seals therebetween, and an opening and closing unit 30 for opening and closing the door 4 or 6 with respect to the main body 2.

The main body 2, the door 4 or 6, and the gasket 7 have already been described in the above section.

Referring to FIGS. 3 to 7, the opening and closing unit 30 is constructed to open and close the door 4 or 6 with respect to the main body 2. Specifically, in order to separate the gasket 7 from the main body 2 in the initial stage of the action of opening the door 4 or 6, the door 4 or 6 must first be spaced apart from the main body 2 using a relatively strong force. Once the gasket 7 is separated from the main body 2, the door 4 or 6 may be rotated using a small force.

The opening and closing unit 30 may be coupled to the door 4 or 6 so as to be disposed in the space defined between the door 4 or 6 and the main body 2. Specifically, the opening and closing unit 30 may be disposed in a space in the upper end or the lower end of the door 4 or 6.

The opening and closing unit 30 may be coupled to the door 4 or 6 by means of a casing. The casing provides a space which enables the opening and closing unit 30 to be secured to the door 4 or 6 and to which respective components of the opening and closing unit 30 are secured.

For example, the casing may include a first casing 310, defining the appearance thereof and having a space in which the opening and closing unit 30 is disposed, and a second casing 313, which is received in the first casing 310 and to which the opening and closing unit 30 is secured.

The opening and closing unit 30 may be disposed outside the area (the inner area of the closed loop) defined by the gasket 7.

By way of example, the opening and closing unit 30 may include a drive unit 320, a gasket separation mechanism 330 and a door rotating mechanism 340.

In another example, the opening and closing unit 30 may include the drive unit 320, the gasket separation mechanism 330, the door rotating mechanism 340 and a synchronizer 350.

The drive unit 320 generates driving force (rotational force) and supplies the driving force to the gasket separation mechanism 330 and the door rotating mechanism 340.

For example, the drive unit 320 may include a motor 321 for generating rotational force and a motor gear 322 for transmitting the rotational force.

The drive unit 320 may be directly or indirectly connected to the gasket separation mechanism 330 and the door rotating mechanism 340.

The driving unit 320 may be connected to the gasket separation mechanism 330 and the door rotating mechanism 340 via a plurality of connecting gears.

Specifically, the motor gear 322 of the drive unit 320 engages with a first connecting gear 325*a*, which in turn engages with a second connecting gear 325*b*, which in turn engages with a third connecting gear 325*c*.

The third connecting gear 325*c* may engage with a push pinion gear 331 of a gasket separation mechanism 330, which will be described later. However, the embodiment of the present invention is not limited thereto, and the linkage may be variously set in consideration of the force and speed that are transmitted from the single motor 321 to the gasket separation mechanism 330 and the door rotating mechanism 340.

The gasket separation mechanism 330 pushes the main body 2 by the rotational force supplied from the drive unit 320, thus separating the gasket 7 from the main body 2 or the door 4 or 6.

In particular, the gasket separation mechanism 330 provides a strong force so as to separate the gasket 7 from the door 4 or 6 or the main body 2 in the initial stage of the action of opening the door 4 or 6. Furthermore, the gasket separation mechanism 330 provides a strong force in the initial stage of the action of opening the door 4 or 6 so as to subsequently enable the door rotating mechanism 340 to rotate the door 4 or 6 using a small force.

The gasket separation mechanism 330 may be connected to the drive unit 320 so as to receive a strong force.

For example, the gasket separation mechanism 330 may include the push pinion gear 331 for transmitting the rotational force of the drive unit 320 and a push rack 33 engaging with the push pinion gear 331 to increase the distance between the main body 2 and the door 4 or 6.

In other words, the gasket separation mechanism 330 converts the rotational force of the drive unit 320 into linear movement in order to space the door 4 or 6 apart from the main body 2.

At this point, the push pinion gear 331 transmits the rotational force of the drive unit 320 to the push rack 333.

Specifically, the push pinion gear 331 engages with the third connecting gear 325*c* so as to receive the rotational force of the drive unit 320.

More specifically, the push pinion gear 331 may include two coaxial sub gears so as to transmit the rotational force to a rotational pinion gear 341 of the door rotating mechanism 340.

The push rack 333 is reciprocated linearly by the rotational force from the push pinion gear 331.

The rotational force of the push pinion gear 331 that moves the push rack 333 linearly is strong and has a low rotational speed.

The push rack 333 is moved linearly in the forward direction of the main body 2, away from the rear surface of the door 4 or 6. Accordingly, the push rack 333 pushes the main body 2 to increase the distance between the main body 2 and the door 4 or 6, thus separating the gasket 7 from the main body 2.

The front surface of the main body 2 is configured to have a flat face for the purpose of contacting the door 4 or 6 and/or the gasket 7. When the door 4 or 6 is spaced apart from the main body 2 by the push rack 333, the door 4 or 6 is rotated about the hinge shaft of the hinge unit 23. As the door 4 or 6 is rotated by the movement of the push rack 33 toward the main body 2, the contact point between the push rack 333 and the main body 2 moves away from the hinge unit 23. Hence, there is a problem in that it is possible to maintain the rotational speed of the door 4 or 6 only by increasing the length of the push rack 333.

In order to solve the problem, the main body 2 may further be provided on the front surface thereof with a rack guide 210, which guides the push rack 333 in close contact therewith.

The rack guide 210 has a space with which the push rack 333 is in close contact. Specifically, the rack guide 210 may have a curved shape that protrudes in the direction of the door 4 or 6 as it moves away from the hinge unit 23.

Specifically, the rack guide 210 may include a guide recess 211 along which the push rack 333 is guided. The guide recess 221 may have a curved shape that protrudes in the direction of the door 4 or 6 as it moves away from the hinge unit 23 when viewed in a plan view, as shown in FIG. 6.

Consequently, even when the door 4 or 6 is rotated, variation in the distance between the rack guide 210 and the main body 2 is compensated for, thus progressively increasing the initial rotational speed of the door 4 or 6.

The gasket separation mechanism 330 is disposed at a position spaced apart from the hinge shaft of the hinge unit 23 by a predetermined distance.

For example, the gasket separation mechanism 330 may be disposed at a position that is spaced apart from the hinge shaft in the direction perpendicular to the hinge shaft (in the direction of the handle of the door 4 or 6).

Specifically, the push rack 333 of the gasket separation mechanism 330 may be disposed at a position that is spaced apart from the hinge shaft in the direction perpendicular to the hinge shaft (in the direction of the handle of the door 4 or 6).

In this description, the hinge shaft refers to an imaginary axis that serves as the rotational axis of the door 4 or 6.

When the push rack 333 is positioned too close to the hinge shaft, which serves as the rotational axis of the door 4 or 6, too much force is required to separate the gasket 7 in the initial stage of the opening action. Meanwhile, when the push rack 333 is positioned too far from the hinge shaft of the door 4 or 6, only a small force is required to separate the gasket 7 in the initial stage of the opening action but there is a problem whereby the volume of the opening and closing unit 30 is increased due to the increase in length of the push rack 333.

Accordingly, the distance between the push rack 333 and the hinge shaft is preferably set to be within a range of 30% to 60% of the width of the door 4 or 6. At this point, the width of the door 4 or 6 refers to the length of the door 4 or 6 in the direction perpendicular to the hinge shaft.

The length of the push rack 333 may be within a range of 20 mm to 40 mm.

The gasket separation mechanism 330 preferably rotates the door 4 or 6 by an angle of 3 to 5 degrees with respect to the front surface of the main body 2.

The push rack 333 includes a first boss 335, which is caught by the synchronizer 350.

The push rack 33 may be restored to its initial position by an elastic restoring force exerted by an elastic member.

The door rotating mechanism 340 rotates the door 4 or 6 by the rotational force transmitted from the drive unit 320.

The door rotating mechanism 340 may be activated after the gasket 7 is separated from the main body 2 or the door 4 or 6 by means of the gasket separation mechanism 330.

The door rotating mechanism 340 rotates the door 4 or 6, which does not require a strong force to be rotated after the separation of the gasket 7 from the main body 2 by the gasket separation mechanism 330. Consequently, the door rotating mechanism 340 is capable of rotating the door 4 or 6 using a small force.

There are various ways to cause the door rotating mechanism 340 to be actuated after the gasket 7 is separated from the main body 2. For example, the gasket separation mechanism 330 and the door rotating mechanism 340 may be controlled independently using a physical synchronizer 350 or a plurality of drive sources.

For example, the door rotating mechanism 340 includes a rotational pinion gear 341 for transmitting the rotational force of the drive unit 320 and a rotational rack 343 that engages with the rotational pinion gear 341 and moves linearly.

The rotational pinion gear 341 serves to transmit the rotational force of the drive unit 320 to the rotational rack 343. The rotational pinion gear 341 may be directly or indirectly connected to the drive unit 320.

Specifically, the rotational pinion gear engages with the push pinion gear 331 so as to receive the rotational force of the drive unit 320.

More specifically, the rotational pinion gear 341 includes two axial sub gears, one of which engages with the push pinion gear 331 and the other of which engages with the rotational rack 343.

The rotational rack 343 is moved linearly by the rotational force transmitted from the rotational pinion gear 341. Specifically, the rotational rack 343 may move linearly in the width direction of the door 4 or 6.

The rotational rack 343 engages with a hinge gear 233 formed on the outer surface of the hinge unit 23.

The rotational rack 343 moves in the direction of the hinge unit 233 during the action of opening the door 4 or 6, and moves in the opposite direction during the action of closing the door 4 or 6.

For example, the rotational rack 343 may include a body 345, an engaging gear 347 formed at one end of the body 345 and engaging with the rotational pinion gear 341, and an acceleration gear 346 formed at the other end of the body 345 and engaging with the hinge gear 233 to change the rotational speed of the door 4 or 6.

The engaging gear 347 is formed on the body 345 in the longitudinal direction of the body 345. Specifically, the engaging gear 347 is disposed to be spaced apart from the rotational pinion gear 341 in the initial stage of the action of opening the door 4 or 6. Subsequently, the engaging gear 347 may be engaged with the rotational pinion gear 341 by an external force.

More specifically, the rotational pinion gear 341 may be positioned at the center of the body 345, and the engaging gear 347 may be formed in a section ranging from one end of the body 345 almost to the center of the body 345.

The acceleration gear 346 engages with the hinge gear 233 and rotates the door 4 or 6 by the linear moving force of the rotational rack 343. Since the hinge gear 233 is in a stationary state, the door 4 or 6, to which the rotational rack 343 is secured, moves relative thereto (i.e. relative to the hinge gear 233) when the rotational rack 343 moves.

The acceleration gear 346 may be configured to change the rotational speed of the door 4 or 6.

For example, the acceleration gear 346 may be configured to have a shape having a varying radius so as to engage with the hinge gear 233.

Specifically, the acceleration gear 346 may include a first gear section **346*a* and a second gear section 346*b***.

The first gear section **346*a* has teeth that are inclined with respect to the moving direction of the rotational rack 343**

The second gear section **346*b* includes teeth parallel to the moving direction of the rotational rack 343**.

The first gear section **346*a* serves to transmit a strong force in the initial stage of the action of rotating the door 4 or 6**.

The hinge unit 23 may include a stationary hinge part 231 secured to the body 2 and a rotatable hinge part 232 secured to the door 4 or 6 and rotatably coupled to the stationary hinge part 231.

The hinge unit 23 is positioned at one end of the door 4 or 6 in the width direction of the door.

Specifically, the hinge gear 233 is formed on the outer surface of the stationary hinge part 231.

When the radius of the hinge gear 233 increases, only a small force is required to rotate the door 4 or 6 but the rotational speed of the door 4 or 6 is low. On the other hand, when the radius of the hinge gear 233 decreases, a strong force is required to rotate the door 4 or 6 but the rotational speed of the door 4 or 6 is high.

Although a strong force is required to rotate the door 4 or 6 in the initial stage of the action of rotating the door 4 or 6, only a small force is required to rotate the door 4 or 6 after the rotational speed is increased above a predetermined speed.

Accordingly, the hinge gear 233 may be configured to have a shape capable of changing the rotational speed of the door 4 or 6 and the force acting on the door 4 or 6.

Specifically, the radius of the hinge gear 233 may decrease in the direction in which the door 4 or 6 opens.

More specifically, the radius of the hinge gear 233 may decrease from a first radius R1 to a second radius R2 as it moves in the direction in which the door 4 or 6 opens.

The section of the hinge gear 233 having the larger radius engages with the first gear section 346*a* of the acceleration gear 346, and the section of the hinge gear 233 having the smaller radius engages with the second gear section 346*b* of the acceleration gear 346.

In the initial stage of the action of opening the door 4 or 6, the acceleration gear 346 of the rotational rack 343 engages with the portion of the hinge gear 233 that has the largest radius. Specifically, in the initial stage of the action of opening the door 4 or 6, the end point of the first gear section 346*a* engages with the portion of the hinge gear 233 that has the largest radius.

For the smooth engagement between the acceleration gear 346 and the hinge gear 233, the first gear section 346*a* may, of course, be curved.

The synchronizer 350 is configured to actuate the door rotating mechanism 340 after the gasket 7 is separated from the main body 2 or the door 4 or 6 by means of the gasket separation mechanism 330. In other words, the synchronizer 350 is configured to actuate the door rotating mechanism 340 after a predetermined period of time has elapsed since the operation of the gasket separation mechanism 330.

The synchronizer 350 may have various configurations which enable the door rotating mechanism 340 to be operated after the operation of the gasket separation mechanism 330.

For example, the synchronizer 350 may be rotated by the push rack 333 so as to cause the rotational rack 343 to engage with the rotational pinion gear 341, as shown in FIG. 7.

Specifically, the synchronizer 350 may be rotated by the push rack 333 so as to move the rotational rack 342 in the direction of the hinge unit 23, to thus cause the rotational rack 342 to engage with the rotational pinion gear 341.

At this time, the rotational rack 342 may engage with the hinge gear 233 by rotation of the rotational pinion gear 341.

More specifically, the synchronizer 350 may include a lever body 351, which is caught at one end thereof by the first boss 335 and at the other end thereof by a second boss 348 formed at the rotational rack 343, and a support pin 353 for rotatably supporting the lever body 351.

The lever body 351 is rotated about the support pin 353 by the first boss 335, and is caught by the second boss 348, thus moving the rotational rack 343.

Hereinafter, the operation of the door opening and closing device for a refrigerator according to the first embodiment of the present invention will be described.

FIGS. 8 to 10 are plan views showing the operation of the door opening and closing device for a refrigerator according to the first embodiment of the present invention.

FIGS. 8 to 10 shows the door opening and closing device for a refrigerator from which the door 4 or 6 and the main body 2 are omitted.

The operation of opening the door 4 or 6 is first described.

Referring to FIG. 8, there is shown the door 4 or 6, which is closed. In the initial stage of the action of opening the door 4 or 6, the rotational rack 343 is in the state of being spaced apart from the hinge gear 233.

As the action of opening the door 4 or 6 is commenced, the motor 321 of the drive unit 320 is activated, and the rotational force of the motor 321 is transmitted to the push pinion gear 331 through the connecting gear.

Referring to FIG. 9, the push pinion gear 331 rotates, and the push rack 333 is thus moved linearly in the rearward direction of the door 4 or 6.

As a result, the door 4 or 6 begins to rotate by the repulsion between the push rack 333 and the main body 2.

As the door 4 or 6 begins to rotate, the variation in the distance between the main body 2 and the push rack 333 is compensated for by the rack guide 210, which is provided on the main body 2.

The gasket 7 is separated from the door 4 or 6 or the main body 2 by the push rack 333.

The lever body 351 of the synchronizer 350 is rotated by the movement of the push rack 333, and the rotational rack 343 is moved by the lever body 351.

Subsequently, the rotational rack 343 engages with the rotational pinion gear 341, and is moved in the direction of the hinge gear 233 due to the rotation of the rotational pinion gear 341.

Thereafter, the acceleration gear 346 of the rotational rack 343 engages with the hinge gear 233.

Referring to FIG. 10, as the rotational rack 343 moves, the door 4 or 6 is rotated and thus opened.

At this point, the rotational speed of the door 4 or 6 may be controlled by adjusting the shapes of the acceleration gear 346 and the hinge gear 233.

The operation of closing the door 4 or 6 is performed is the inverse order of the operation of opening the door 4 or 6.

The operation of closing the door 4 or 6 commences when the motor 321 of the drive motor 320 rotates in the direction opposite to the rotational direction of the motor 321 in the operation of opening the door 4 or 6.

When the door 4 or 6 comes into contact with the main body 2, the push rack 333 provides a buffering effect.

FIG. 11 is a control block diagram of a door opening and closing device for a refrigerator according to a second embodiment of the present invention.

Referring to FIG. 11, the door opening and closing device for a refrigerator according to the second embodiment of the present invention may further include an input unit 360 and a control unit 370 in addition to the components of the first embodiment. In the following description, descriptions of the components of the second embodiment that are identical to those of the first embodiment will be omitted.

The input unit 360 receives signals for the operation of opening and closing the door 4 or 6.

The input unit 360 generates input data, input by a user so as to control the operation of the door 4 or 6. The input data received in the input unit 360 is sent to the control unit 370.

The input unit 360 may recognize a user's voice and may convert an opening or closing command corresponding to the user's voice into an electronic signal (input data).

Furthermore, the input unit 360 may recognize a user's touch and may convert an opening or closing command corresponding to the user's touch into an electronic signal.

For example, the input unit 360 may be constituted by a key pad, a dome switch, a touch pad (electrostatic/pressure-sensitive), a jog wheel, a jog switch, a slide switch, a finger mouse, or the like.

The control unit 370 may control the opening and closing unit 30 by the command input through the input unit 360.

The control unit 370 may control the ON/OFF operation, rotational speed and rotational direction of the motor 321 of the drive unit 320.

Specifically, when a door opening command is input through the input unit 360, the control unit 370 activates the motor 321 of the drive unit 320 to open the door 4 or 6. Meanwhile, when a door closing command is input through the input unit 360, the control unit 370 activates the motor 321 of the drive unit 320 to close the door 4 or 6.

After a predetermined load has been applied to the motor 321 during the rotation of the door 4 or 6, the control unit 370 may determine that the door 4 or 6 is caught by an obstacle and may halt the rotation of the motor 321 of the drive unit 320.

FIG. 12 is a control block diagram of a door opening and closing device for a refrigerator according to a third embodiment of the present invention.

Referring to FIG. 12, when compared to the second embodiment, the door opening and closing device for a refrigerator according to the third embodiment of the present invention has the distinguishing feature of including a door switch 22 and a drive unit 320 having two separate driving force supplies for respectively driving the gasket separation mechanism 330 and the door rotating mechanism 340.

The door switch 22 detects that the door 4 or 6 is open at a predetermined angle with respect to the main body 2, and sends the result of the detection to the control unit 370.

The door switch 22 may be constructed by various known technologies capable of detecting the opening of the door 4 or 6.

The drive unit 320 may include a first driving force supply 327 for supplying rotational force to the gasket separation mechanism and a second driving force supply 329 for supplying rotational force to the door rotating mechanism 340.

Unlike the second embodiment, the door opening and closing device for a refrigerator according to the third embodiment of the present invention is constructed such that the gasket separation mechanism 330 and the door rotating mechanism 340 are operated by separate driving force supplies rather than by the transmission of rotational force through engagement between the gasket separation mechanism 330 and the door rotating mechanism 340.

The first driving force supply 327 supplies rotational force to the push pinion gear 331, and the second driving force supply 329 supplies rotational force to the rotational pinion gear 341.

Accordingly, the door opening and closing device for a refrigerator according to the third embodiment of the present invention may exclude the synchronizer 350.

The control unit 370 operates the first driving force supply 327 and the second driving force supply 329 in response to a signal input through the door switch 22 such that there is a time interval between operation of the first driving force supply 327 and operation of the second driving force supply 329.

Specifically, in the action of opening the door 4 or 6, the control unit 370 operates the first driving force supply 327 to separate the gasket 7 from the main body 2, and then operates the second driving force supply 329 to rotate the door 4 or 6 in response to a signal input through the door switch 22. Naturally, in the operation of closing the door 4 or 6, the closing operation is performed in the inverse order of the operation of closing the door 4 or 6.

MODE FOR INVENTION

Various embodiments have been described in the best mode for carrying out the invention. Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A door opening and closing device for a refrigerator comprising:

a door coupled to a main body defining a storage compartment therein, by means of a hinge unit;

a gasket disposed between the door and the main body to provide a hermetic seal therebetween; and an opening and closing unit for opening and closing the door with respect to the main body, wherein the opening and closing unit comprises:

a drive unit for generating a driving force;

a gasket separation mechanism for pushing the main body using rotational force transmitted from the drive unit to separate the gasket from the main body or the door; and a door rotating mechanism for rotating the door using the rotational force transmitted from the drive unit, wherein the gasket separation mechanism comprises:

a push pinion gear configured to transmit the rotational force of the drive unit and a push rack configured to engage with the push pinion gear and to increase a distance between the main body and the door, wherein the door rotating mechanism comprises:

a rotational pinion gear configured to transmit the rotational force of the drive unit; and a rotational rack configured to engage with the rotational pinion gear and to move linearly, wherein the rotational rack engages with a hinge gear located on an outer surface of the hinge unit, and wherein the door opening and closing device further comprises a synchronizer that is configured to be rotated by the push rack to thereby cause the rotational rack to engage with the rotational pinion gear.

2. The door opening and closing device for a refrigerator according to claim 1, wherein the door rotating mechanism is configured to rotate the door based on the gasket separation mechanism having pushed the main body to thereby separate the gasket from the main body or the door.

3. The door opening and closing device for a refrigerator according to claim 2, wherein the push rack moves linearly toward a front of the main body from a rear side of the door.

4. The door opening and closing device for a refrigerator according to claim 3, wherein the push rack is spaced apart from an axis of the hinge unit by a distance ranging from 30% to 60% of a width of the door.

5. The door opening and closing device for a refrigerator according to claim 3, further comprising a rack guide provided on a front surface of the main body to guide the push rack, wherein the rack guide progressively protrudes as it moves in a direction of the door as it moves away from the hinge unit.

6. The door opening and closing device for a refrigerator according to claim 1, further comprising a door switch for detecting that the door is open at a predetermined angle with respect to the main body, wherein the drive unit comprises:

a first driving force supply for supplying rotational force to the gasket separation mechanism; and a second driving force supply for supplying rotational force to the door rotating mechanism, wherein the door opening and closing device further comprises a control unit for operating the first and second driving force supplies in response to a signal input through the door switch such that there is a time interval between operation of the first driving force supply and operation of the second driving force supply.

7. The door opening and closing device for a refrigerator according to claim 1, wherein the rotational rack moves linearly in a width direction of the door, and the synchronizer is rotated by the push rack so as to move the rotational rack toward the hinge unit.

8. The door opening and closing device for a refrigerator according to claim 1, wherein the rotational rack comprises:

a body;

an engaging gear formed at one end of the body to engage with the rotational pinion gear; and an acceleration gear formed at another end of the body to engage with the hinge gear so as to change a rotational speed of the door.

9. The door opening and closing device for a refrigerator according to claim 8, wherein the acceleration gear comprises:

a first gear section inclined with respect to a moving direction of the rotational rack; and a second gear section parallel to the moving direction of the rotational rack.

10. The door opening and closing device for a refrigerator according to claim 8, wherein the hinge gear has a radius that decreases toward an opening direction of the door.

11. The door opening and closing device for a refrigerator according to claim 10, wherein, in an initial stage of an action of opening the door, the acceleration gear of the rotational rack engages with a portion of the hinge gear that has a largest radius.

12. The door opening and closing device for a refrigerator according to claim 3, wherein the opening and closing unit is coupled to the door so as to be positioned in a space defined between the door and the main body.

13. The door opening and closing device for a refrigerator according to claim 12, wherein the opening and closing unit is positioned outside an area defined by the gasket.

14. The door opening and closing device for a refrigerator according to claim 1, further comprising:

an input unit through which a door opening or closing command is input; and a control unit for controlling the opening and closing unit in response to the door opening or closing command input through the input unit.

15. The door opening and closing device for a refrigerator according to claim 14, wherein the input unit inverts an opening or closing command input by user's voice or touch into an electronic signal.

16. The door opening and closing device for a refrigerator according to claim 1, wherein the storage compartment is cooled by a cooling device which exchanges heat with an outside of the storage compartment.

17. The door opening and closing device for a refrigerator according to claim 1, wherein the gasket separation mechanism is disposed to be spaced apart from a hinge shaft of the hinge unit by a predetermined distance.

* * * * *